US009863706B2

(12) United States Patent
Gonzalez et al.

(10) Patent No.: US 9,863,706 B2
(45) Date of Patent: Jan. 9, 2018

(54) SINTERING PALLET CAR SIDE WALL

(71) Applicant: Cast Steel Products LP, Edmonton, Alberta (CA)

(72) Inventors: Cristobal J Gonzalez, Tampa, FL (US); Ray Hernandez, Jr., Tampa, FL (US)

(73) Assignee: Cast Steel Products LP, Edmonton, Alberta (CA)

( * ) Notice: Subject to any disclaimer, the term of this patent is extended or adjusted under 35 U.S.C. 154(b) by 44 days.

(21) Appl. No.: 14/851,967

(22) Filed: Sep. 11, 2015

(65) Prior Publication Data

US 2017/0016671 A1 Jan. 19, 2017

Related U.S. Application Data

(60) Provisional application No. 62/193,873, filed on Jul. 17, 2015.

(51) Int. Cl.
*F27B 21/00* (2006.01)
*F27B 21/02* (2006.01)

(52) U.S. Cl.
CPC ..... *F27B 21/02* (2013.01)

(58) Field of Classification Search
CPC ..... F27B 21/02
USPC ..... 266/178
See application file for complete search history.

(56) References Cited

U.S. PATENT DOCUMENTS 3,824,071 A * 7/1974 Lovold ..... F27B 21/02 266/180
4,289,485 A * 9/1981 Latowski ..... C22B 1/20 266/178
2015/0125800 A1* 5/2015 Schulakow-Klass ... F27B 21/02 432/11
2017/0016671 A1* 1/2017 Gonzalez ..... F27B 21/02

OTHER PUBLICATIONS

Outotec Oyj, Outotec Pallet Cars or Sintering and Pelletizing, 2012, pp. 1-4.

* cited by examiner

*Primary Examiner* — Scott Kastler

(57) ABSTRACT

The invention relates to a sidewall for use in a sintering pallet car. The sidewall has a base for connection to a frame of the pallet car and a wall extending upwardly from the base to a top. The wall has opposing ends, opposing interior and exterior faces, and a height as measured from the base to the top. An elongate brace is disposed on the exterior face intermediate of the opposing ends, the brace extending downwards from the top towards the base. The sidewall may include an arcuate protrusion disposed on the interior face intermediate the opposing ends of the sidewall or a cap extending between the opposing ends of the sidewall and joining the exterior and interior faces, the cap having a protruding lip extending from the exterior face. The sidewall may comprise a top segment and a bottom segment, releasably securable to each other.

18 Claims, 9 Drawing Sheets

SINTERING PALLET CAR SIDE WALL

CROSS-REFERENCE TO RELATED APPLICATION

This application claims priority to U.S. Provisional Application No. 62/193,873 entitled "Sintering Pallet Car Side Wall" filed on Jul. 17, 2015, the contents of which are hereby incorporated by reference in its entirety.

TECHNICAL FIELD

The present invention relates to a sidewall for a pallet car.

BACKGROUND

When pelletizing or sintering ore the bulk material to be treated (for example iron ore or zinc ore) is loaded onto a pallet car where a plurality of cars forms an endless chain, also referred to as traveling grate. The pallet cars are filled with the bulk material and pass through various treatment stations, in which a thermal treatment of the material, such as drying, firing and cooling, is effected.

The pallet cars move along an endless path into the sintering furnace and experience high radiant heat as the material to be sintered is treated. The pallet cars experience substantial differential heating and cooling, in repetitive cycles, and as a consequence their components tend to expand and contract leading to warping and cracking, as well as loosening of components relative to each other.

Sidewalls enclose the bulk material to be treated, and are subjected to harsh conditions, especially the uppermost third portion which is closest to the radiant heat. Differential heating and cooling of sidewalls can lead to warping, cracking and loosening of connections with adjacent components. Existing sidewalls have limited structural bracing and inadequate material composition to reduce the structural deformation and material degradation which results from differential heating and cooling. Existing sidewalls tend to be made from materials such as ASTM A-297 HH with ferrite, which is susceptible to chrome degradation and/or corrosion and high temperature oxidation.

Furthermore, a single piece sidewall must be removed in its entirety for repair or maintenance, which may require partial disassembly of the pallet car. The resulting downtime increases expenses and cost of doing business.

Therefore, there is a need to provide a sidewall for sintering pallet car that overcomes the drawbacks of prior art sidewalls.

SUMMARY OF THE INVENTION

It is an embodiment of the present invention to provide a sidewall of a sintering machine pallet car configured to reduce differential heating and cooling or to reduce maintenance and repair requirements.

In one broad aspect of the invention, there is provided a sidewall for use in a sintering pallet car, the sidewall comprising: a base for connection to a frame of the pallet car; a wall extending upwardly from the base to a top, the wall having opposing ends, opposing interior and exterior faces, and a height as measured from the base to the top; and an elongate brace disposed on the exterior face intermediate of the opposing ends, the brace extending downwards from the top towards the base.

According to an embodiment of the present invention, the elongate brace extends downwards from the top and towards the base for about ⅓ of the height of the sidewall.

According to an embodiment of the present invention, the wall further comprises an arcuate protrusion disposed on the interior face intermediate the opposing ends of the sidewall.

According to an embodiment of the present invention, the arcuate protrusion substantially comprises a segment of a cylinder, sphere, or ellipsoid.

According to an embodiment of the present invention, the longitudinal axis of the arcuate protrusion is oriented along the interior face, between the top and the base of the sidewall.

According to an embodiment of the present invention, the top of the sidewall comprises a cap extending between the opposing ends of the sidewall and joining the exterior and interior faces, the cap having a protruding lip extending from the exterior face.

According to an embodiment of the present invention, the top of the sidewall comprises a substantially cylindrical cap having a longitudinal axis extending between the opposing ends of the sidewall, the cap joining the exterior and interior faces and having a diameter greater than the thickness of the wail as measured between the interior and exterior faces.

According to an embodiment of the present invention, the ratio of the diameter of the cap to the height of the sidewall is about 1:8.

According to an embodiment of the present invention, the base is connected to the frame by a lower sidewall configured for attachment to the base of the sidewall and the frame of the pallet car.

According to, an embodiment of the present invention, the lower sidewall has a height, as measured between the frame and the base, and the ratio of the height of the sidewall to the height of the lower sidewall is 1:2.

According to an embodiment of the present invention, the base of the sidewall further comprises a protruding foot, for attachment of the base to the lower sidewall.

According to an embodiment of the present invention, the base and the lower sidewall are connected by a dovetail connection.

According to an embodiment of the present invention, the sidewall comprises a top segment and a bottom segment, the top segment and the bottom segment being releasably securable to each other.

According to an embodiment of the present invention, the top segment and the bottom segment are connected by a dovetail connection.

According to an embodiment of the present invention, the ratio of the height of the top segment to the height of the sidewall as measured between the top to the base is 2:1.

According to an embodiment of the present invention, the ratio of the height of the top segment to the width of the underside of the top segment can be from 3.5:1 to 0.91.

According to an embodiment of the present invention, the ratio of the height of the top segment to the width of the underside of the top segment is around 3:1.

According to an embodiment of the present invention, the ratio of the height of the sidewall to the width of the underside of the top segment can be from 0.9:1 to 1.9:1.

According to an embodiment of the present invention, the interior face of the sidewall is corrugated.

According to an embodiment of the present invention, the opposing ends of the sidewall further comprise end braces extending from the top to the base.

According to an embodiment of the present invention, the opposing ends are substantially triangular.

According to an embodiment of the present invention, the ratio of the height of the sidewall to the width of the base is from 4:1 to 1:1.

According to an embodiment of the present invention, the ratio of the height of the sidewall to the width of the base is around 3.6:1.

According to an embodiment of the present invention, the ratio of the height of the sidewall to the width of the base is from 3.5:1 to 0.9:1.

According to an embodiment of the present invention, the ratio of the height of the sidewall to the width of the base is from 0.9:1 to 1.9:1.

According to an embodiment of the present invention, the ratio of the height of the sidewall to the width of the base is around 2:1.

According to an embodiment of the present invention, the sidewall comprises a concentration of chrome, nickel, or chrome and nickel.

According to an embodiment of the present invention, the sidewall has a chromium content from between 26-30% and more preferably around 29%, and a nickel content of around 14-20% and more preferably around 20%.

According to an embodiment of the present invention, the sidewall is made from Z-999-L.

According to another broad aspect of the present invention, there is provided a sidewall for use in a sintering pallet car, the sidewall comprising: a base for connection to a frame of the pallet car; a wall extending upwardly from the base to a top, the wall having opposing ends, opposing interior and exteriors faces, and a height as measured from the base to the top; and an arcuate protrusion disposed on the interior face intermediate the opposing ends of the sidewall.

According to yet another broad aspect of the present invention, there is provided a sidewall for use in a sintering pallet car, the sidewall comprising: a base for connection to a frame of the pallet car; a wall extending upwardly from the base to a top, the wall having opposing ends, opposing interior and exterior faces, and a height as measured from the base to the top; and a substantially cylindrical cap at the top of the wall, the cap having a longitudinal axis extending between the opposing ends of the sidewall and joining the exterior and interior faces of the wall, the cap having a diameter greater than the thickness of the wall as measured between the interior and exterior faces.

DETAILED DESCRIPTION

Figure 1:
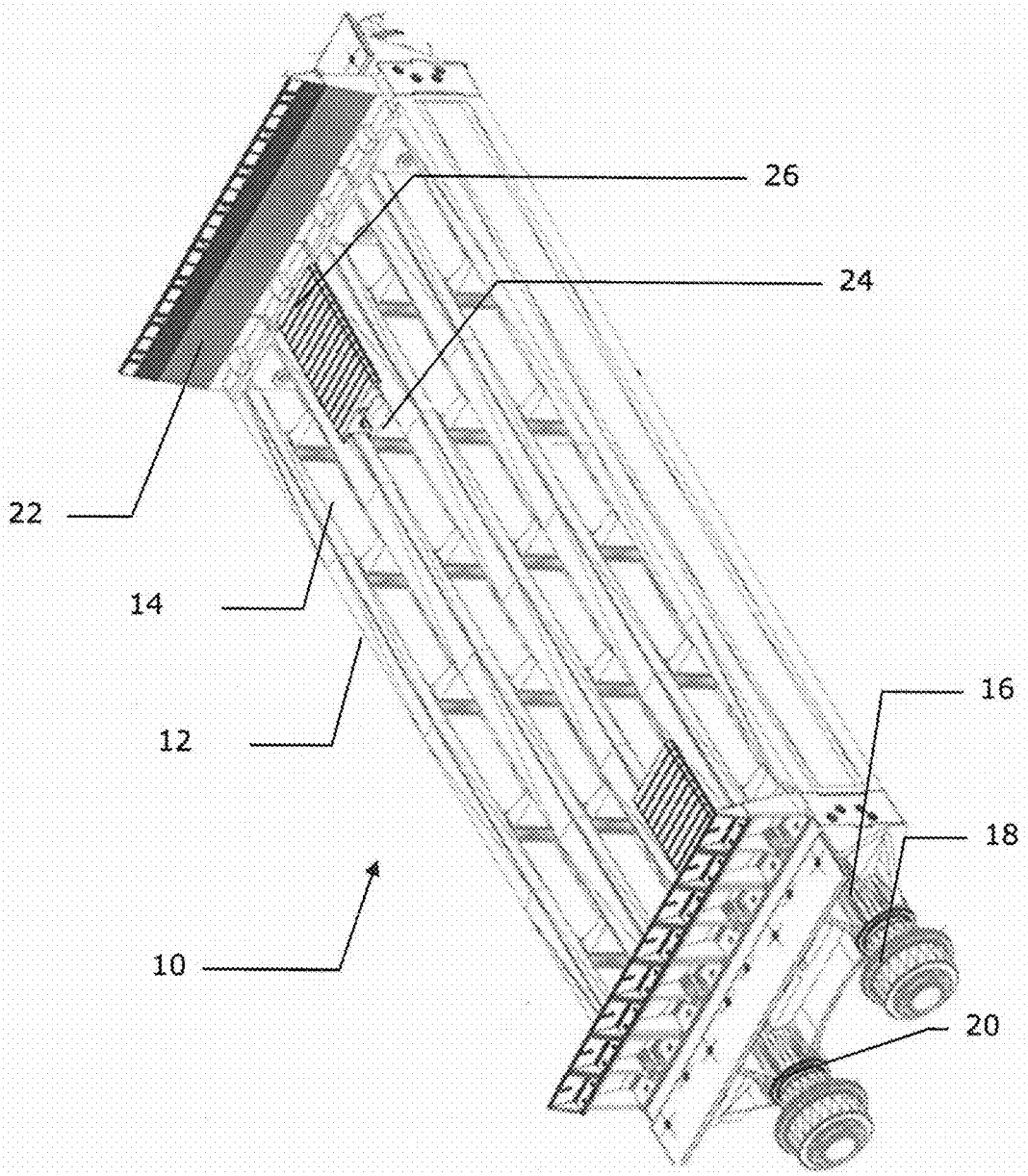
FIG. 1 is a perspective view of a pallet car which includes a sidewall assembly in accordance with an embodiment of the invention.

Reference will now be made to exemplary embodiments of the invention, examples of which are illustrated in the accompanying drawings. Wherever possible, the same reference numerals used throughout the drawings refer to the same or like parts.

An embodiment of the sidewall for use with a sintering pallet car of a pellitizing machine for producing ore pellets is depicted in FIGS. 1 through 5. As shown in FIG. 1 an individual pallet car 10 comprises a frame 12 for supporting a loading bay 14 for carrying bulk material (not shown) to be treated by the pellitizing machine. The frame 12 itself is supported by a track assembly 16 comprising track rollers 18 and pressure roller bearings 20. Track rollers 18 are for rollably support the pallet car 10 on an endless track (not shown). Pressure roller bearings 20 releasably engage drive wheels and driven wheels (not shown) of the pelletizing machine to propel the car 10 on the endless track.

The loading bay 12 is formed from two opposing pallet car walls 22 and a floor 24 comprising a plurality of grate bars 26. Car walls 22 are formed by one or more sidewalls 28 arranged adjacent to one another across the width and along outer side of the pallet car 10.

Figure 2A:
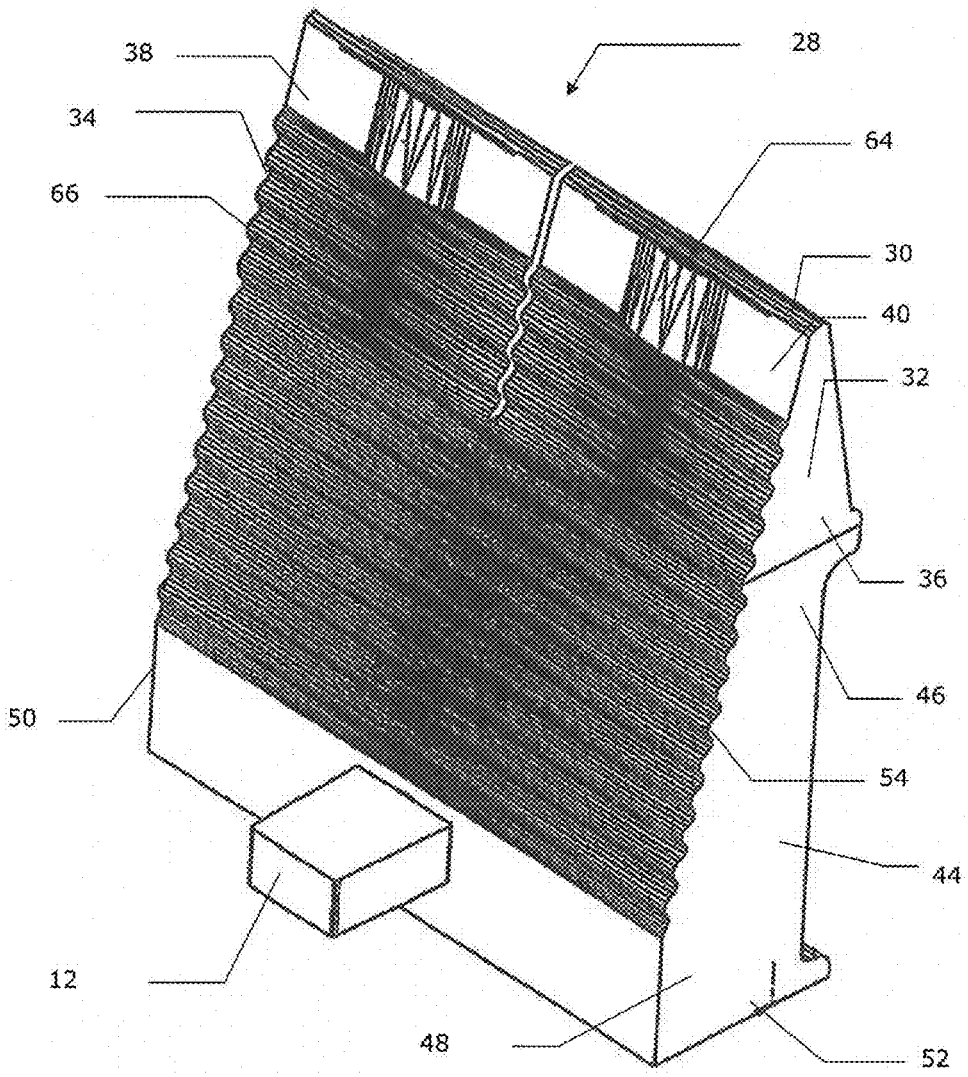
FIG. 2*a* is a front perspective view of the sidewall assembly of FIG. 1 which includes a sidewall in accordance with an embodiment of the invention.
Figure 2B:
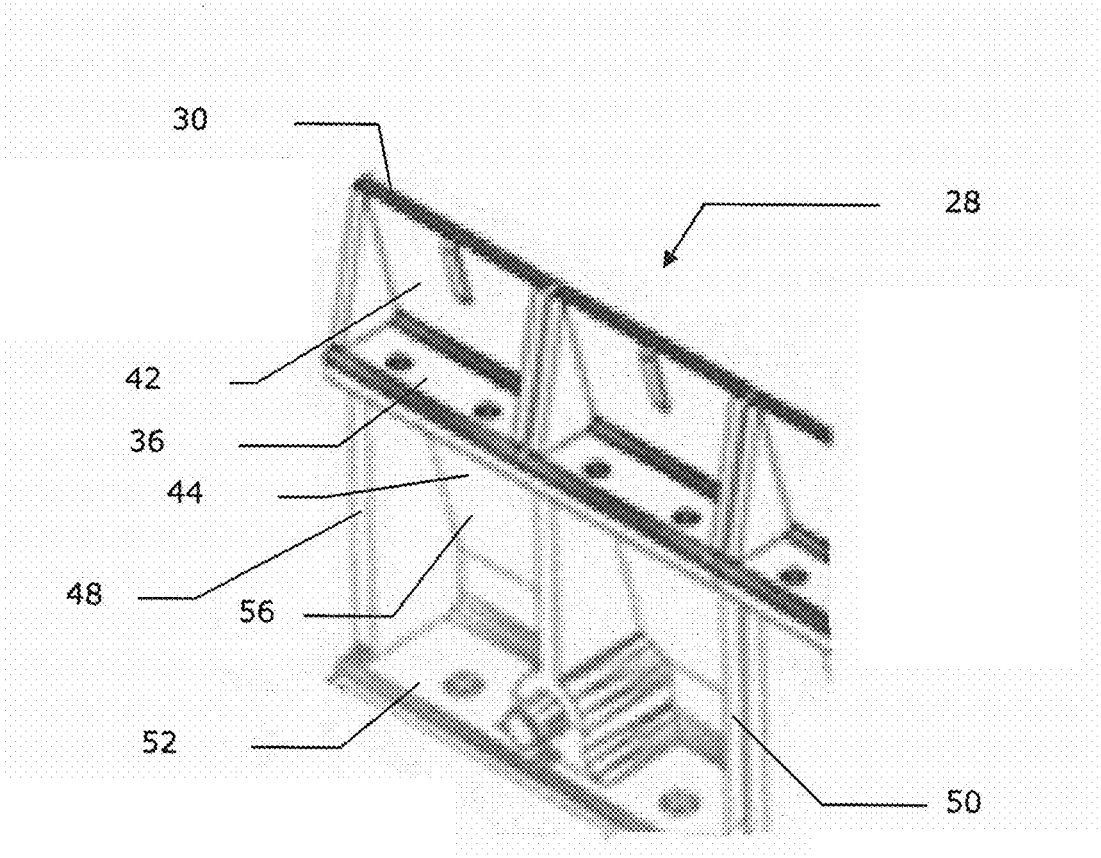
FIG. 2*b* is a rear perspective view of the sidewall assembly of FIG. 2*a;*

As depicted in FIGS. 1, 2*a* and 2*b*, in general, the sidewall 28 comprises a top 30, opposing ends 32, 34, a base 36, and a wall 38 having opposing interior face 40 and exterior face 42. In the embodiment shown in FIGS. 2*a* and 2*b*, the base 36 is connected to the frame 12 by a lower sidewall 44. The lower sidewall 44 includes a top 46 for reversibly securing the sidewall 28, opposing ends 48, 50, a bottom portion 52 for attachment to the frame 12, and opposing interior 54 and exterior faces 56. In the embodiment the shown in FIGS. 1 and 2, the ratio of the height of the sidewall 28 to the height of the lower sidewall is around 1:2.

Sidewall 28 will now be described in more detail with reference to FIGS. 2*a* through 5. The wall 38 forms an acute angle with the base 36 such that the sidewall 28 assumes a generally L-shaped cross-section. The sidewall 28 has a certain height as measured from the top 30 to the base 36. In the embodiment the shown in FIGS. 1-5, the ratio of the height of the sidewall 28 to the width of the base 36 is around 2:1. It will be appreciated that the ratio of the height of the sidewall 28 to the width of the base 36 can be from 3.5:1 to 0.9:1. In some embodiments, the ratio of the height of the sidewall 28 to the width of the base 36 is from 0.9:1 to 1.9:1.

In the embodiment of the sidewall 28 shown in FIGS. 2*a*-4, the opposing ends 32, 34 form end braces 58, 60 which may extend downwards from the top 30 to the base 36. In this embodiment, the end braces 58, 60 assume a generally triangular shape and the sidewall 28 assumes a generally hollowed-out form. It will be understood that the end braces 58, 60, in some embodiments, may provide additional structural strength and bracing, and improved heat transfer.

Figure 3:
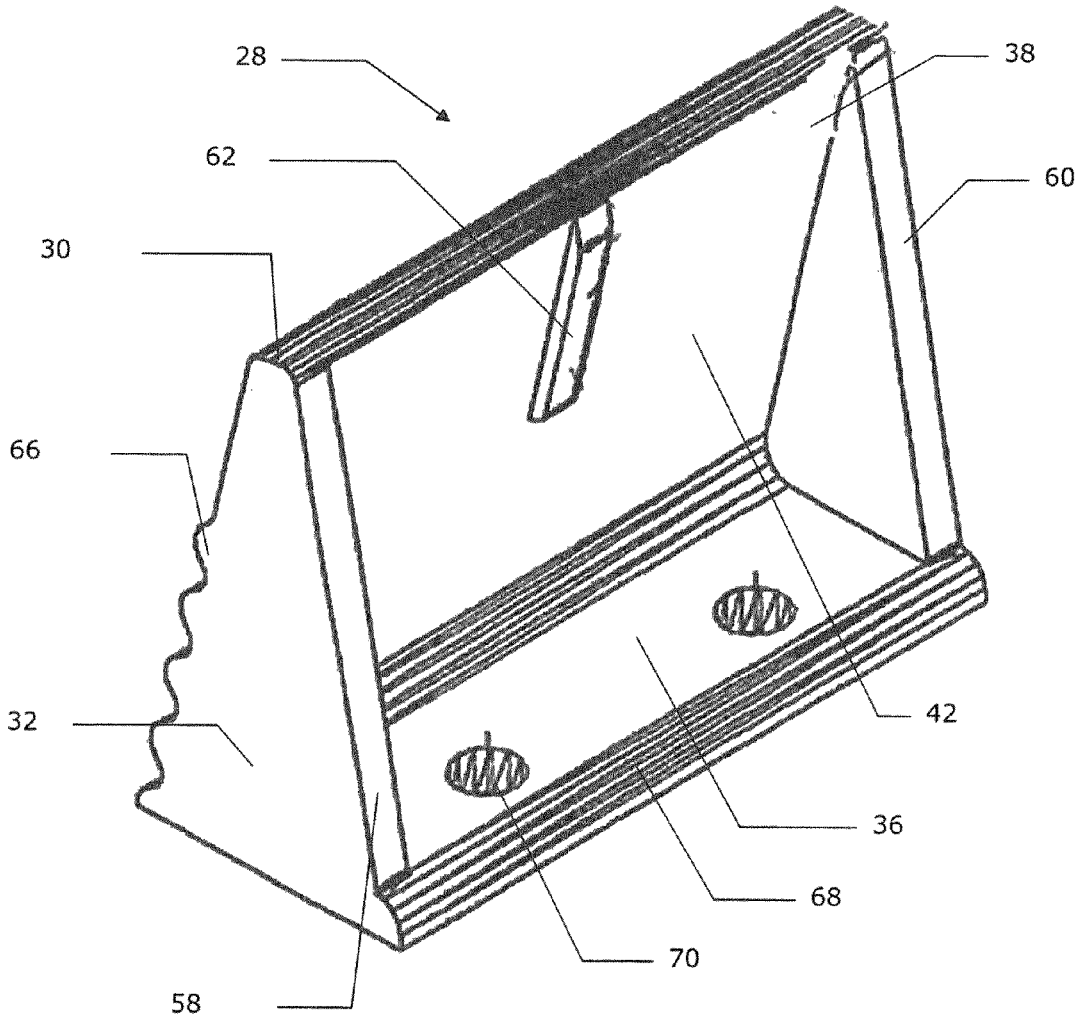
FIG. 3 is a rear perspective view of the sidewall of FIG. 2*a;*
Figure 4:
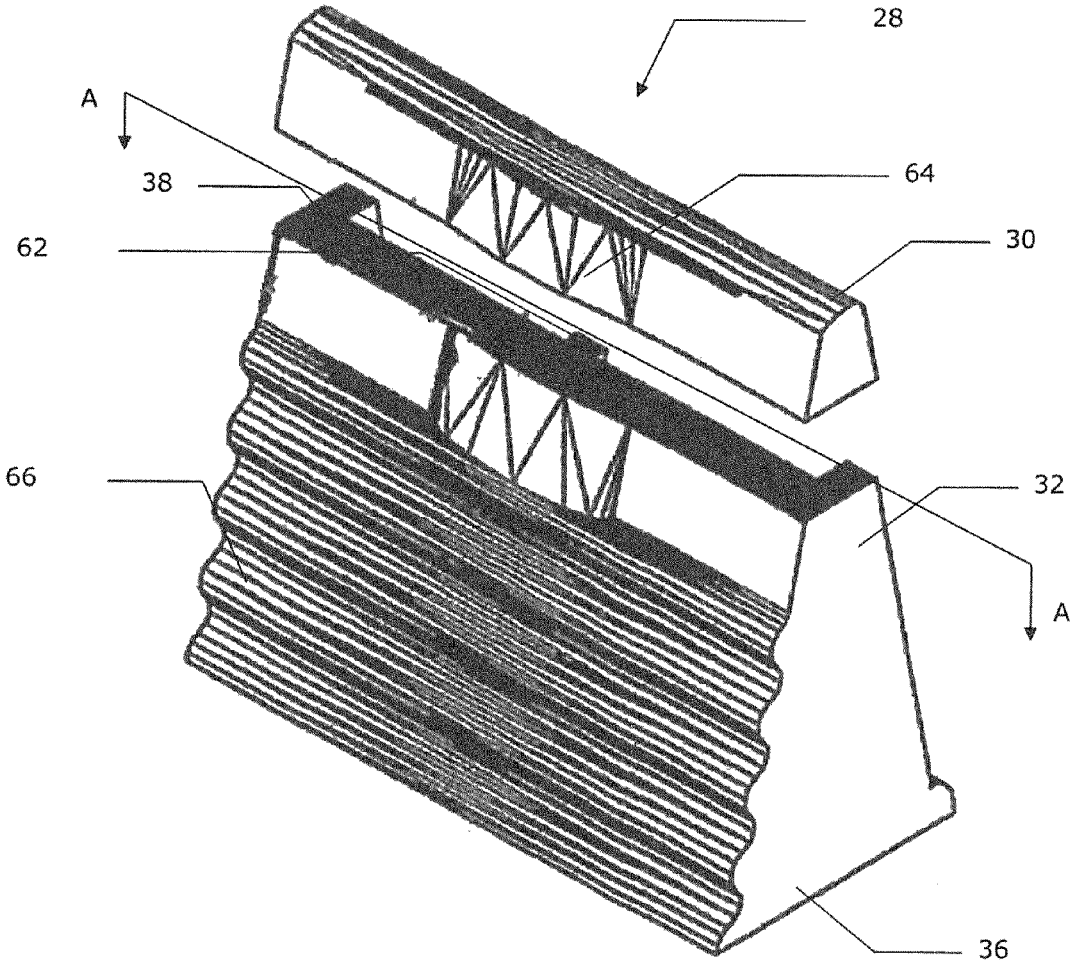
FIG. 4 is a front exploded perspective view of the sidewall of FIG. 2*a;*
Figure 5:
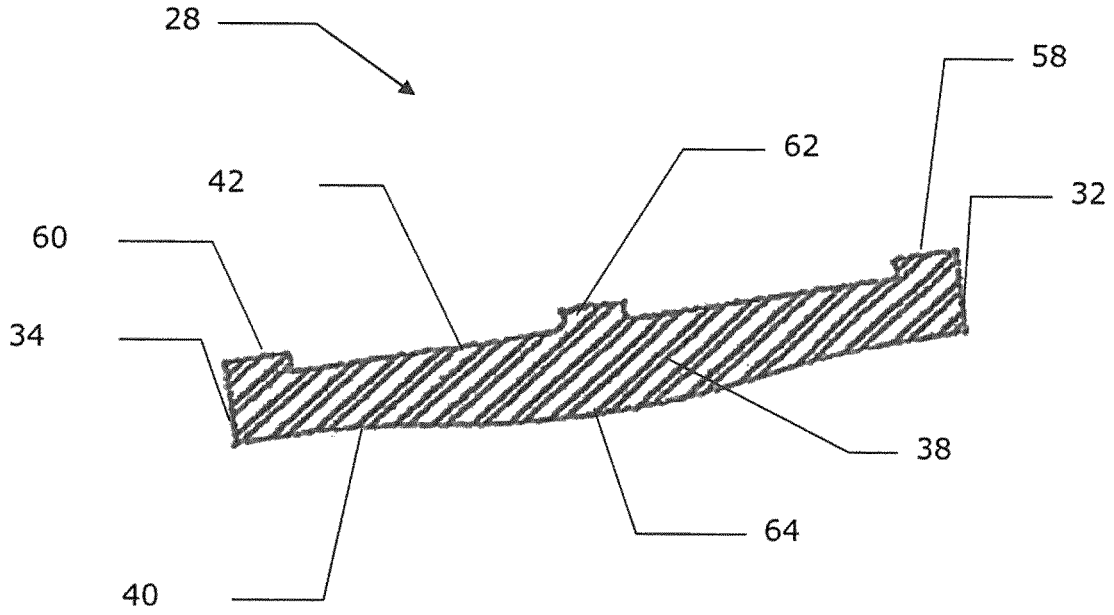
FIG. 5 is a cross section& view of the sidewall of FIG. 4 cut along the line A-A.

With reference to FIGS. 3-5, an elongate brace 62 is disposed on the exterior face 42 intermediate of the opposing ends 32, 34, and extending downwards from the top 30 towards the base 36. In the embodiment shown, the brace 62 extends downwards from the top 30 and towards the base for about ⅓ of the height of the sidewall 28. It will be understood that in some embodiments, this arrangement of brace 62 may provide additional strength and bracing, and improved heat transfer.

With reference to FIGS. 2*a*, 4, and 5, sidewall 28 includes an arcuate protrusion 64 disposed on the interior face 40 intermediate the opposing ends 32, 34. In this embodiment, the arcuate protrusion 64 is a segment of a cylinder. In other embodiments, the arcuate protrusion 64 may be a segment of a sphere, or ellipsoid. Minor variations from cylinders, spheres, and ellipsoids are also contemplated, as are other forms of arcuate protrusions 64. In the embodiment shown in FIGS. 2*a*, 4, and 5, the longitudinal axis of the protrusion 64 is oriented along the interior face 40, between the top 30 and the base 36 of the sidewall 28. In other embodiments, the longitudinal axis may be oriented between the opposing ends 32, 34.

With reference to FIGS. 4 and 5, it will be understood that the combination of the arcuate protrusion 64 and the brace 62 serve to increase the cross-sectional area of the wall 38 as measured between the interior 40 and exterior 42 faces in a region intermediate the opposing ends 32, 34. In some embodiments, this arrangement may provide additional strength and bracing, and improved heat transfer.

A portion of the interior surface 40 of the sidewall 28 includes corrugations 66. In the embodiment shown in FIGS. 3 and 4, there are between 4-5 individual cylindrical-like protrusions forming the corrugations 66 that span the opposing ends 32, 24 of the sidewall 28. A portion of interior surface 54 of the lower sidewall 44, where present, may also include corrugations 66. In some embodiments, the corrugations 66 may assist in heat transfer and the cooling and may additionally reduce weight of the sidewall 28 or the lower sidewall 44. It will be appreciated that the total number and the dimensions of the individual cylindrical-like protrusions forming the corrugations 66 can be varied as necessary depending on the situation.

Sidewall 28 may also be provided with a protruding foot 68 which may be used to help secure to the sidewall 28 to the lower sidewall 44 by known reversible mechanical coupling, such as for example, by a threaded bolt and nut arrangement through an aperture 70 formed in the base 36 and through a corresponding aperture (not shown) in top portion 46 of the lower sidewall 44.

Figure 6:
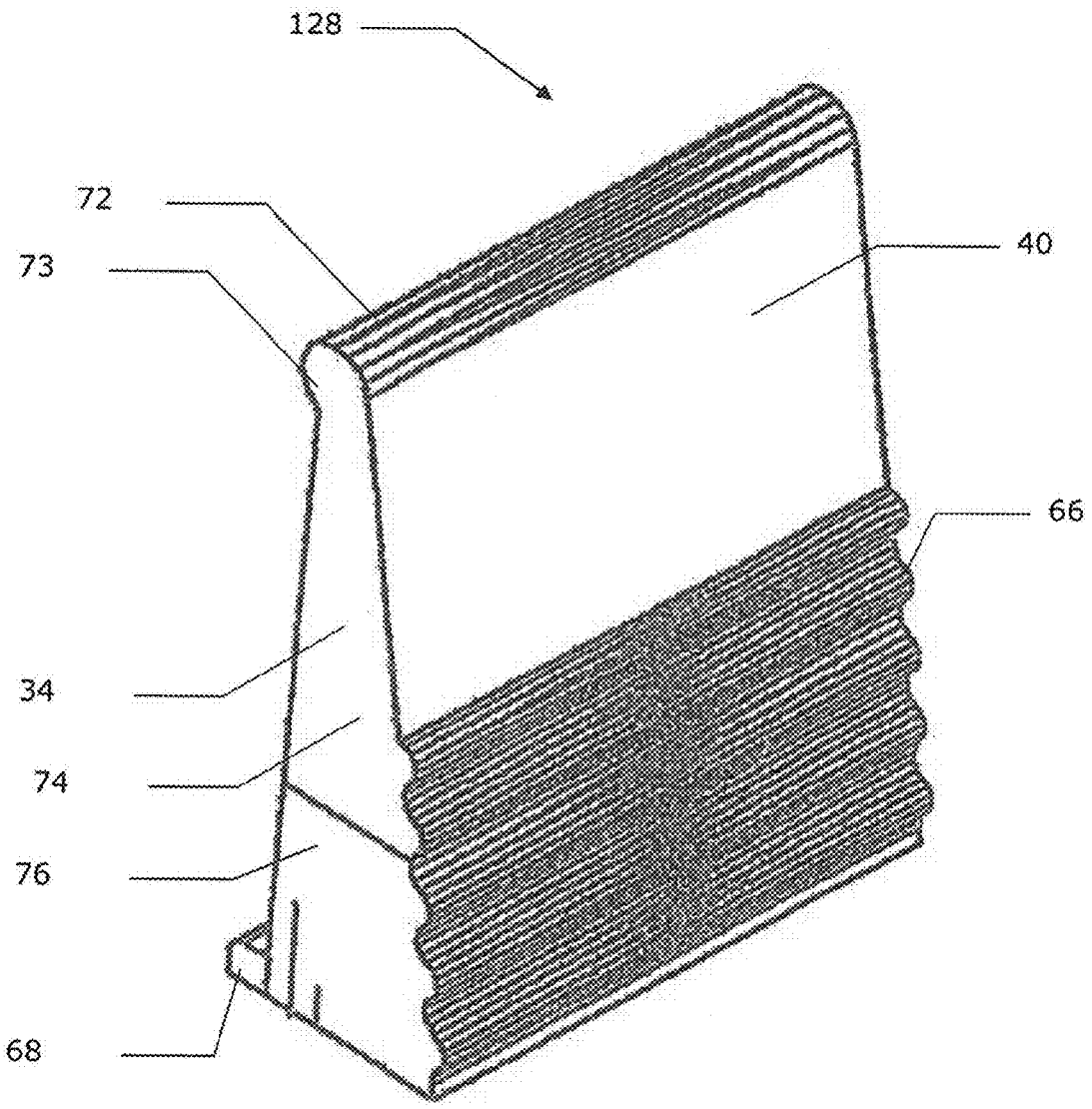
FIG. 6 is a front perspective view of an upper sidewall in accordance with yet another embodiment of the invention in which the sidewall is comprised of top and bottom segments.
Figure 7:
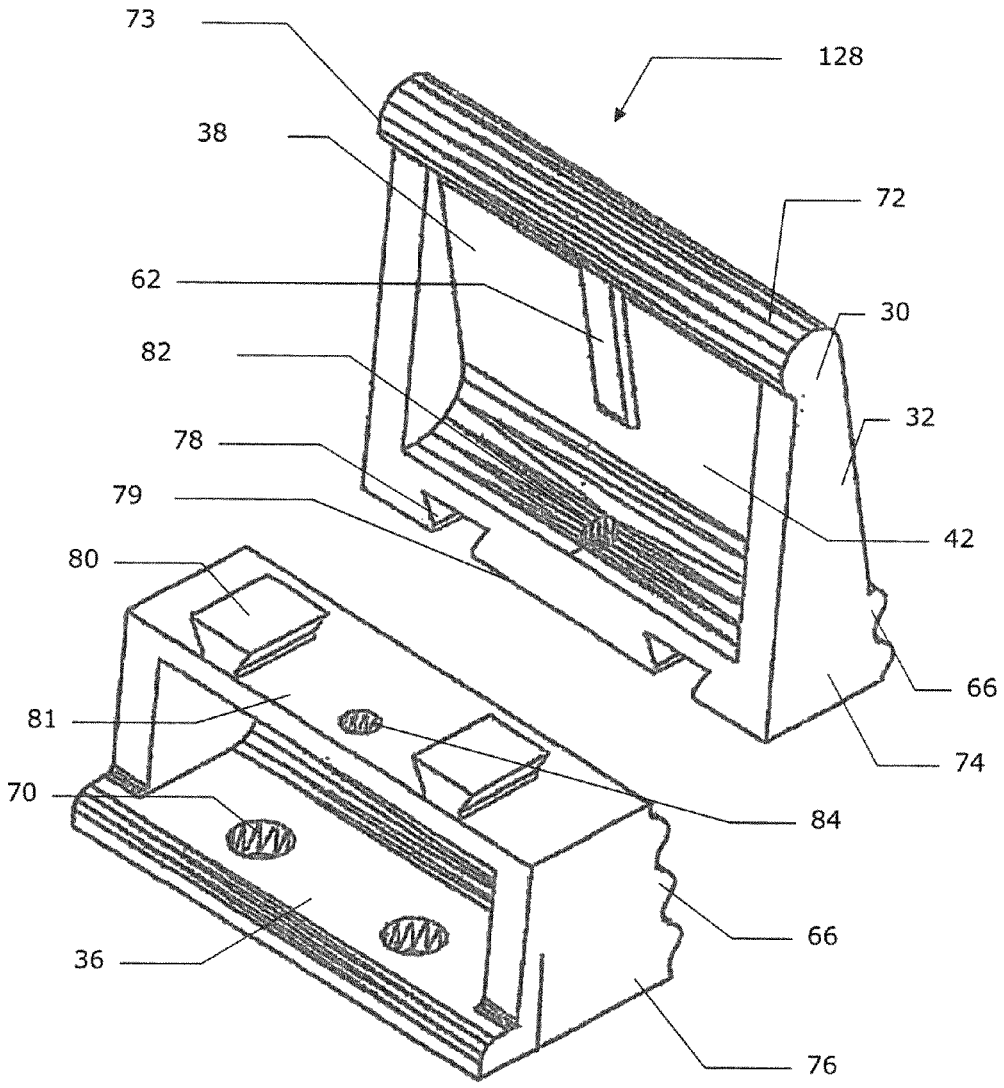
FIG. 7 is a rear perspective view of the sidewall of FIG. 6 showing the separation of the top segment from the bottom segment.

FIGS. 6 and 7 depict another embodiment of the invention. In this embodiment, sidewall 128 includes a cap 72 at the top 30, which is substantially cylindrical and has a longitudinal axis extending between the opposing ends 32, 34 of the sidewall 128. The cap 72 joins interior face 40 and exterior face 42 and has a diameter greater than the thickness of the wall 38 as measured between the interior 40 and exterior 42 faces. According to the embodiment shown, the ratio of the diameter of the cap 72 to the height of the sidewall 128 is about 1:8. In other embodiments, cap 72 may comprise a protruding lip 73 extending from the exterior face 42 which is non-cylindrical, such as a rectangular prism. When present, the cap 72 may, in some embodiments, provide additional strength and bracing, and improve heat transfer with minimal thickness.

The embodiment shown in FIGS. 6 and 7 also provides a sidewall 128 that is divisible into two separate segments: a top segment 74 and a bottom segment 76. It will be understood that the top segment 74 can be removed for servicing whilst leaving the bottom segment 76 attached to the pallet car 10. In some embodiments, providing a sidewall 128 which can be separated may lead to a reduction of maintenance, with resulting reduced out-of-service time, as well as cost savings.

As shown in FIGS. 6 and 7, the top segment 74 and the bottom segment 76 are releasably securable to each other by a dovetail connection. In the embodiment shown, grooves 78 formed in an underside 79 of the top segment 74 are configured to receive tongues 80 formed in a topside 81 of the bottom segment 76. It will be understood that the top segment 74 and bottom segment 76 can be separated quite easily from each other to facilitate the repair and replacement process of sidewall 128. The top segment 74 and bottom segment 76 may also be locked together using known mechanical couplings, such as for example, by a threaded bolt and nut arrangement through apertures 82 and 84.

In the embodiment shown in FIGS. 6 and 7, there are 5 individual cylindrical-like protrusions forming the corrugations 66 which span the opposing ends 32, 24 of the sidewall 128. The total number and the dimensions of the individual cylindrical-like protrusions forming the corrugations 66 can be varied as necessary depending on the situation.

In the embodiment shown in FIGS. 6 and 7, the ratio of the height of the top segment 74 to the height of the sidewall 128 as measured between the top 30 to the base 36 is 2:1. In the embodiment shown in FIGS. 6 and 7, the ratio of the height of the sidewall 128 to the width of the base 36 is around 3.6:1. It will be appreciated that the ratio of the height of the sidewall 128 to the width of the base 36 can be from 4:1 to 1:1. In the embodiment shown in FIGS. 6 and 7, the ratio of the height of the top segment 74 to the width of the underside 79 is around 3:1. It will be appreciated that the ratio of the height of the top segment 74 to the width of the underside 79 can be from 3.5:1 to 0.9:1. In another embodiment, the ratio of the height of the top segment 74 to the width of the underside 79 is from 0.9:1 to 1.9:1. It will be understood that the configuration of the two segment sidewall 128, allows each segment to be removed and be repaired as necessary, without having to remove the entire or at least large sections of the car wall 26 to facilitate repairs.

Figure 8:
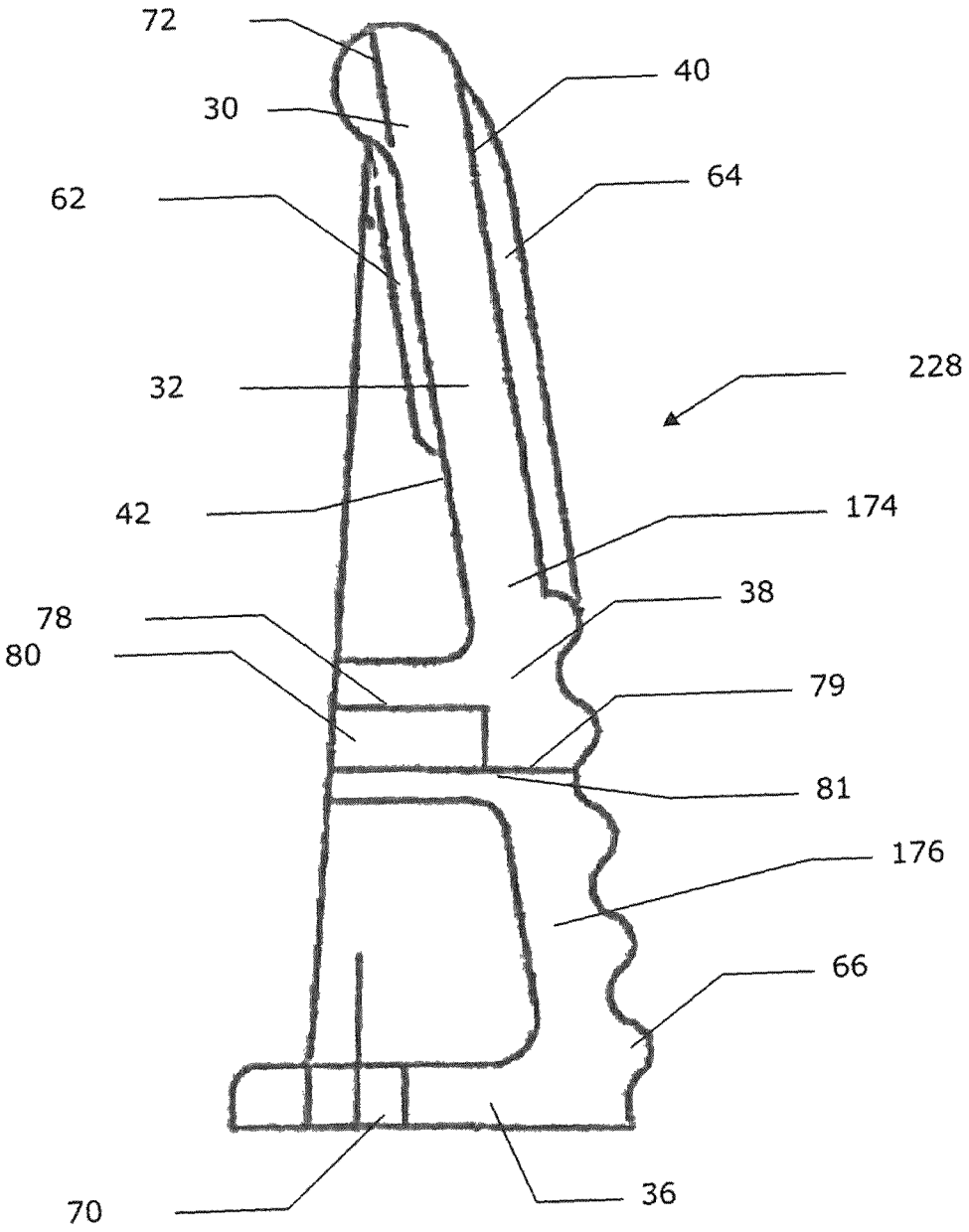
FIG. 8 is a side elevation cross sectional view of a sidewall in accordance with yet another embodiment of the invention.

Shown in FIG. 8 is yet another embodiment of the sidewall configured to reduce differential heating and cooling and to reduce maintenance and repair requirements. Similar to sidewall 128, sidewall 228 is divisible into two separate segments, a top segment 174 and a bottom segment 176. Top segment 174 and bottom segment 176 are releasably securable to each other, for example, by dovetail connection. The connection is formed, for example, by grooves 78 formed in the underside 79 of the top segment 174. The grooves 78 are configured to receive tongues 80 formed in the topside 81 of the bottom segment 176.

Sidewall 228 comprises elongate brace 62 disposed on the exterior face 42 intermediate of the opposing ends 32, 34, and extending downwards from the top 30 towards the base 36 and terminating at about an intermediate point therebetween.

Sidewall 228 further comprises arcuate protrusion 64 disposed on the interior face 40 intermediate the opposing ends 32, 34 (not shown). Cap 72 is also located at the top 30. The cap 72 is substantially cylindrical and has a longitudinal axis extending between the opposing ends 32, 34 (not shown) of the sidewall 228. The cap 72 joins the exterior 42 and interior 40 faces and has a diameter greater than the thickness of the wall 38 as measured between the interior 40 and exterior 42 faces. A portion of interior surface 40 also includes corrugations 66.

Sidewalls 28, 128, and 228 may be formed using high grade chrome (such as A297 grade HI) to minimize chrome degradation. The sidewalls 28, 128, and 228 may also contain a higher nickel content to increase resistance to corrosion and high temperature oxidation. An exemplary material for forming the sidewalls 28, 128, and 228 of the present invention is Z-999-L which contains higher concentrations of chrome and nickel. In some embodiments, the chemical composition of the alloy has a chromium content from between 26-30% and more preferably around 29%, and a nickel content of around 14-20% and more preferably around 20%.

In the embodiments shown in FIGS. 6-8, it will be appreciated that the top segments 74, 174 and the bottom segments 76, 176 of the sidewalk 128 and 228, respectively, can be formed using different materials in order to maintain costs, allow for flexibility and customization opportunities depending on the specific need.

For example, in some applications, the region of the sidewall 128 and 228 around the bottom segments 76, 176 has been shown to be susceptible to significant material degradation as compared to other regions of the sidewall 128 and 228. In providing this modular arrangement to the sidewalk 128 and 228 comprising top and bottom segments which are easily disengaged to each other, it will be appreciated that the user would not only be able to swap in any replacement top segment 74, 174 and bottom segment 76, 176 as necessary, but the particular segments which are actually shown to be subjected to the most wear could easily be identified and replaced with components made of more durable alloy compositions or be replaced more frequently with least expensive compositions, depending on the situation.

The embodiments of the present application described above are intended to be examples only. Those of skill in the art may effect alterations, modifications and variations to the particular embodiments without departing from the intended scope of the present application. In particular, features from one or more of the above-described embodiments may be selected to create alternate embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present application as a whole. Any dimensions provided in the drawings are provided for illustrative purposes only and are not intended to be limiting on the scope of the invention. The subject matter described herein and in the recited claims intends to cover and embrace all suitable changes in technology.

The invention claimed is:

1. A sidewall for use in a sintering pallet car, the sidewall comprising:

a wall extending upwardly from a base to a top, the base being configured for connection to a frame of the pallet car, the wall having opposing ends, opposing interior and exterior faces, and a height as measured from the base to the top, wherein the wall comprises a top segment, and a bottom segment releasably securable to the top segment, wherein the top segment and the bottom segment are connected to one another by a dovetail connection; and an elongate brace disposed on the exterior face intermediate of the opposing ends, the brace extending downwards from the top towards the base.

2. The sidewall of claim 1, wherein the elongate brace extends downwards from the top and towards the base for about ⅓ of the height of the sidewall.

3. The sidewall of claim 1, wherein the ratio of the height of the sidewall to the width of the base is around 2:1.

4. The sidewall of claim 1, wherein the wall further comprises an arcuate protrusion disposed on the interior face intermediate the opposing ends of the sidewall.

5. The arcuate protrusion of claim 4, wherein the arcuate protrusion substantially comprises a segment of a cylinder, sphere, or ellipsoid.

6. The arcuate protrusion of claim 5, wherein the longitudinal axis of the arcuate protrusion is oriented along the interior face, between the top and the base of the wall.

7. The sidewall of claim 4, wherein the top of the wall comprises a cap extending between the opposing ends of the sidewall and joining the exterior and interior faces, the cap having a protruding lip extending from the exterior face.

8. The sidewall of claim 7 wherein the ratio of the diameter of the cap to the height of the sidewall is about 1:8.

9. The sidewall of claim 4, wherein the top of the wall comprises a substantially cylindrical cap having a longitudinal axis extending between the opposing ends of the sidewall, the cap joining the exterior and interior faces and having a diameter greater than the thickness of the wall as measured between the interior and exterior faces.

10. The sidewall of claim 9 wherein the ratio of the diameter of the cap to the height of the sidewall is about 1:8.

11. The sidewall of claim 1, wherein the ratio of the height of the top segment to the height of the sidewall as measured between the top to the base is 2:1.

12. The sidewall of claim 1, wherein the ratio of the height of the top segment to the width of an underside of the top segment is from 3.5:1 to 0.9:1.

13. The sidewall of claim 1, wherein a portion of the interior face of the sidewall is corrugated.

14. The sidewall of claim 13, wherein the opposing ends of the sidewall further comprise end braces extending from the top to the base.

15. The sidewall of claim 13, wherein the ratio of the height of the sidewall to the width of the base is from 4:1 to 1:1.

16. The sidewall of claim 15, wherein the ratio of the height of the sidewall to the width of the base is around 3.6:1.

17. A sidewall for use in a sintering pallet car, the sidewall comprising:

a wall extending upwardly from a base to a top, the base being configured for connection to a frame of the pallet car, the wall having opposing ends, opposing interior and exteriors faces, and a height as measured from the base to the top, wherein the wall comprises a top segment, and a bottom segment releasably securable to the top segment, wherein the top segment and the bottom segment are connected to one another by a dovetail connection; and an arcuate protrusion disposed on the interior face intermediate the opposing ends of the sidewall.

18. A sidewall for use in a sintering pallet car, the sidewall comprising:

a wall extending upwardly from a base to a top, the base for connection to a frame of the pallet car, the wall having opposing ends, opposing interior and exterior faces, and a height as measured from the base to the top, wherein the wall comprises a top segment, and a bottom segment releasably securable to the top segment, wherein the top segment and the bottom segment are connected to one another by a dovetail connection; and a substantially cylindrical cap at the top of the wall, the cap having a longitudinal axis extending between the opposing ends of the sidewall and joining the exterior and interior faces of the wall, the cap having a diameter greater than the thickness of the wall as measured between the interior and exterior faces.

* * * * *